US005536990A

United States Patent [19]

Nelson

[11] Patent Number: 5,536,990

[45] Date of Patent: Jul. 16, 1996

[54] PIEZOELECTRIC IGNITER

[75] Inventor: Bradley W. Nelson, North Ogden, Utah

[73] Assignee: Thiokol Corporation, Ogden, Utah

[21] Appl. No.: 675,512

[22] Filed: Mar. 27, 1991

[51] Int. Cl.[6] ..... H01L 41/08

[52] U.S. Cl. ..... 310/339; 102/210

[58] Field of Search ..... 310/328, 329, 310/338, 339; 102/210

[56] References Cited

U.S. PATENT DOCUMENTS

| | | | |
|---|---|---|---|
| H372 | 11/1987 | Campbell . | |
| 1,832,855 | 11/1931 | Bok | 102/337 |
| 1,894,954 | 1/1933 | Johnson et al. | 102/337 |
| 2,764,091 | 9/1956 | Hudson | 310/339 |
| 2,799,788 | 7/1957 | Fitzgerald et al. | 310/339 |
| 2,849,957 | 9/1958 | Küller et al. | 102/70.2 |
| 2,853,011 | 9/1958 | Will et al. | 102/70.2 |
| 2,892,411 | 6/1959 | Brown et al. | 102/70.2 |
| 2,900,906 | 8/1959 | Olsen | 102/210 |
| 3,031,968 | 5/1962 | Dowdell et al. | 102/70.2 |
| 3,181,466 | 5/1965 | Czajkowski | 102/70.2 |
| 3,320,890 | 5/1967 | Ciccone et al. | 310/339 |
| 3,337,758 | 8/1967 | Brothers | 310/339 |
| 3,349,709 | 10/1967 | Vilbajo | 102/210 |
| 3,356,026 | 12/1967 | Lubig | 310/339 |
| 3,359,904 | 12/1967 | Nerheim | 310/339 |
| 3,593,664 | 7/1971 | Davis et al. | 102/210 |
| 3,624,451 | 11/1971 | Gould | 102/70.2 A |
| 3,633,509 | 1/1972 | Grandy | 102/338 |
| 3,698,320 | 10/1972 | Cochran et al. | 102/49.3 |
| 3,712,232 | 1/1973 | Abel et al. | 102/210 |
| 3,967,141 | 6/1976 | Gawlick et al. | 102/210 |
| 3,976,898 | 8/1976 | Newson | 310/328 |
| 3,977,328 | 8/1976 | Brown et al. | 102/210 |
| 4,056,009 | 11/1977 | Sonderegger et al. | 73/406 |
| 4,090,448 | 5/1978 | Rose et al. | 310/339 |
| 4,176,608 | 12/1979 | Ambrosini et al. | 102/216 |
| 4,226,185 | 10/1980 | Tobler et al. | 102/35.4 |
| 4,241,662 | 12/1980 | Rüdenauer et al. | 102/210 |
| 4,280,410 | 7/1981 | Weidner | 102/210 |
| 4,440,060 | 4/1984 | Berkley | 102/221 |
| 4,487,125 | 12/1984 | Zuk | 102/220 |
| 4,495,434 | 1/1985 | Diepers et al. | 341/34 |
| 4,586,437 | 5/1986 | Miki et al. | 102/220 |
| 4,651,648 | 3/1987 | Alon | 102/387 |
| 4,699,241 | 10/1987 | Kerekes | 181/116 |
| 4,708,060 | 11/1987 | Bickes, Jr. et al. | 102/202.7 |
| 4,723,087 | 2/1988 | Fox et al. | 310/329 |
| 4,729,315 | 3/1988 | Proffit et al. | 102/202.9 |
| 4,767,967 | 8/1988 | Tanaka et al. | 315/55 |
| 4,793,256 | 12/1988 | Webb | 102/210 |
| 4,815,390 | 3/1989 | Garcia | 102/489 |
| 4,825,765 | 5/1989 | Ochi et al. | 102/206 |
| 5,003,881 | 4/1991 | Herold et al. | 102/337 |
| 5,022,324 | 6/1991 | Rice, Jr. | 102/201 |
| 5,157,220 | 10/1992 | Schaffhauser et al. | 102/210 |

FOREIGN PATENT DOCUMENTS

| | | | |
|---|---|---|---|
| 2206646 | 8/1972 | Germany | 102/210 |
| 0189681 | 8/1986 | Japan | 310/339 |

*Primary Examiner*—Thomas M. Dougherty
*Attorney, Agent, or Firm*—Madson & Metcalf; Ronald L. Lyons

[57] ABSTRACT

A device for producing an electrical output within a larger apparatus which generates the electrical output by use of energy already available within the apparatus. The device is particularly adaptable for use within an apparatus which incorporates an explosive charge which detonates during the operation of the apparatus. The device employs a piezoelectric cell which is positioned within the apparatus at a location such that when a force or shock wave is generated within the apparatus, that force is at least partially applied to the piezoelectric cell. Thus, an electrical voltage is generated by the piezoelectric cell. The device also includes a wire or other device for transporting the electrical energy to an appropriate location for use. The device may be placed within a flare of the type propelled by a rocket motor and also having an explosive charge for separating the rocket motor from the remainder of the flare. The piezoelectric cell is in turn placed in electrical communication with an igniter for the illuminate of the flare. For some purposes the piezoelectric cell may be shielded from the explosive or other force producing component by means of a burst diaphragm.

1 Claim, 2 Drawing Sheets

PIEZOELECTRIC IGNITER

BACKGROUND

1. The Field of the Invention

The present invention is related to a piezoelectric device for igniting, or otherwise initiating components within an apparatus, such as a flare or other projectile. More particularly, the present invention is related to a device for converting forces otherwise present in an apparatus, to electricity by means of a piezoelectric cell.

2. Technical Background

In a number of contexts it is necessary to initiate a sequence of events in the operation of a device, which sequence of events may necessarily take place at a location remote from an abundant source of energy, fuel, or other supplies. This is particularly the case in many aerospace and military devices. Such devices must necessary perform a sequence of well defined functions, at precisely specified times, and at a location which is some distance from the point of origin of the device. For example, devices such as missiles, rockets, spacecraft, and many other similar devices essentially become projectiles during normal operation.

In each such device, a series of functions must necessarily be performed at a location remote from the point of origin of the device. In order for a spacecraft to achieve its desired orbit, several rocket motor or booster stages may be used. In addition, it may be necessary at some point to separate the spacecraft itself from the bulk of the rocket motors or boosters. Each stage in the operation of the booster must be initiated at a precise predetermined time in the flight sequence of the device.

Another example is in the deployment of a flare. A number of sophisticated flare designs are known and are used to provide necessary light to a remote area. These flares are generally powered by a rocket motor. When the flare reaches a particular desired location, one or more parachutes are deployed in order to place the flare in the air over the desired location. At the same time, it is necessary to ignite the illuminant material contained within the flare. Each of these functions must be performed at a precise time within the operational sequence of the device. Each of these functions must clearly be initiated at a point remote from the point of origin of the flare and using only mechanical, electrical, and chemical mechanisms contained within the flare itself.

One of the problems encountered in these types of devices is that space is limited. In order to power such devices it is necessary to use a relatively large quantity of fuel in order to achieve the speeds necessary, and to cover the desired distances. At the same time, materials required to perform necessary functions, such as illuminant in the case of the flare, take up a substantial amount of the available space. It is desirable to maximize this type of load. As a result, space within this type of device is at a premium and it is clearly very desirable to provide such devices with mechanisms for initiating necessary functions which are compact to the maximum extent possible.

Reliability is another serious concern. When a device is traveling rapidly toward its destination, it must function properly. If any part of the device fails to operate, the device may become totally ineffective and useless and may also become a serious safety hazard. This is particularly true because in-flight repair or adjustment may be impossible.

As mentioned above, another important consideration is safety. In many of the device described above, highly flammable or explosive materials are used. It is, therefore, important that a mechanism which initiates a function within the device do so only at the appropriate time. If certain functions, such as illumination of a flare, occurred prematurely, such an event would clearly present a serious safety hazard. Thus, great effort is taken to prevent premature or unsafe operation of this type of device.

The present invention teaches the use of a piezoelectric material to provide electrical output for initiation of certain sequences and functions. Piezoelectric materials may be naturally occurring crystalline materials, such as quartz and tourmaline. Alternatively, materials known as polarized piezoelectric ceramics are also available. These are typically referred to as ferroelectric materials. In contrast to naturally occurring piezoelectric crystals, ferroelectric ceramics are of "polycrystalline" structure. Such materials include lead zirconate titanate, barium titanate, lead titanate, and lead metaniobate.

Piezoelectric ceramics and related materials have been used widely in certain contexts. For example, it is known to use a piezoelectric material as an impact detonator for certain types of explosives. The piezoelectric material is placed within the nose of an explosive charge. When the charge impacts on a target, an electrical output is created, which can be used to initiate the explosive material. Similarly, piezoelectric materials have been used as base detonators. That is, they have been placed in the base of a projectile and have been used to detonate an explosive carried by the projectile. Various modifications of this concept have been disclosed.

Piezoelectric ceramics, however, have not typically been used to initiate operating functions other than triggering an explosion. In initiating operating functions within a device it has not been a known concept to use otherwise wasted energy to produce onboard electrical energy. While the energy of impact has been used to produce electrical energy for detonation, other types of functions have not typically been initiated by electrical energy produced during operation of the device.

Accordingly, it would be an advancement in the art to provide an additional mechanism for initiating operational functions within devices such as military and aerospace devices. It would also be an advancement in the art to provide such initiation devices which were at the same time compact, reliable, and safe. It would be another advancement in the art to provide such a device which was able to generate a usable electrical output using energy otherwise produced during normal operation of the device. It would be a further advancement in the art to provide such a device which incorporated piezoelectric generating capability, and which was able to produce sufficient electrical output for the necessary purposes.

Such a device is disclose and claimed herein.

BRIEF SUMMARY AND OBJECTS OF THE INVENTION

The present invention provides a device for producing an electrical output within the context of a larger apparatus. The device is designed to generate the electrical output by use of energy already available within the apparatus, but which is otherwise wasted. The present invention is particularly adaptable for use within an apparatus which incorporates an explosive charge which detonates during the normal operation of the apparatus.

As an important aspect, the present invention teaches the use of a piezoelectric cell. The piezoelectric cell is positioned within the device at a chosen location such that when a force or shock wave is generated within the apparatus, that force is at least partially applied to the piezoelectric cell. As a result of the application of the force against the piezoelectric ceramic, an electrical voltage is generated by the piezoelectric cell. Unlike piezoelectric impact detonators or base detonators, however, the present invention uses an explosion or other force produced by the apparatus, and directs the resulting electrical output in such a manner that a further component of the apparatus is activated.

The present invention provides means for transporting the electrical voltage to another location in the apparatus, where it is used to initiated a further function. That transportation means may simply be a wire or other conventional method of transporting an electrical current. The invention is, however, unique in its ability to provide such onboard energy generation and transportation.

In one embodiment of the invention, the device is placed within a flare of the type propelled by a rocket motor. Such flares also have an explosive charge for separating the rocket motor from the remainder of the flare, and for deployment of a parachute. In such an apparatus, the piezoelectric cell is placed just forward of the rear mounted rocket motor and associated "separation charge." Thus, when the separation charge is initiated for the purpose of ejecting the rocket motor, a portion of the force from the detonation impacts the piezoelectric cell producing an electric voltage.

The piezoelectric cell is in turn placed in electrical communication, through a wire or similar structure, with an igniter for the illuminant of the flare. The electric output from the piezoelectric cell may, for example, contact a squib which then initiates Boron/KNO3 pellets in the igniter. The ignited Boron/KNO3 pellets in turn ignite the main body of illuminant contained within the flare.

An important aspect of the present invention is that the piezoelectric cell be used in conjunction with a squib or other component which is capable of activation by the relatively small output of the piezoelectric cell. In one embodiment of the invention, the piezoelectric cell is used in conjunction with a semiconductor bridge (or "SCB"). These devices can be made to operate reliability with less than approximately 0.25 milli-Joules of output, which is well within the range of modern piezoelectric cells. In the case of the flare, the SCB squib is placed adjacent to the Boron/KNO3 pellets such that ignition of the squid also results in the ignition of the pellets.

In one embodiment of the present invention, the piezoelectric cell is shielded from the explosive, or other force producing component, by a burst diaphragm. Burst diaphragms are preferably selected which burst under a predetermined force. As a result, the explosion or other force must reach a certain intensity before the diaphragm bursts and the piezoelectric cell is impacted. In this manner the output of the piezoelectric cell can be controlled and regulated and a reliable power output is produced.

The present invention also improves and simplifies the safety features of the apparatus. Since the piezoelectric cell is isolated, there is little danger of accidental activation of the associated squib. Only a force of sufficient magnitude, directed in a specific direction, will operate the device. Mere mishandling of the apparatus will not result in triggering the device.

The present invention saves space and weight within the apparatus. The flare can be used for purposes of illustration. In conventional flares, as the parachute is deployed it pulls on a lanyard, which in turn operates the igniter mechanism. The lanyard runs between the parachute and the igniter, through the illuminant compartment. Using the present invention it is possible to eliminate the lanyard. Using the present invention it is also possible to eliminate the striker of the igniter and the associated redundant safety mechanisms. Thus, weight and space are conserved, resulting in the ability to carry more illuminant within the device, and to maximize performance.

It is, therefore, an object of the present invention to provide a mechanism for initiating operational functions within devices such as military and aerospace devices, which mechanism overcomes the limitations of existing devices.

It is a further object of the present invention to provide such initiation devices which are at the same time compact, reliable, and safe.

It is also a primary object of a the present invention to provide such a device which is able to generate a usable electrical output employing energy otherwise produced during normal operation of the device.

It is an additional object of the present invention to provide a device which incorporates piezoelectric generating capability, but which is able to produce sufficient electrical output for necessary purposes within a larger apparatus.

These and other objects of the present invention will become apparent upon reference to the following detailed description and appended claims, and upon reference to the accompanying drawings.

DETAILED DESCRIPTION OF THE DRAWINGS

DETAILED DESCRIPTION OF THE PREFERRED EMBODIMENTS

The present invention can be more fully appreciated with reference to the accompanying drawings wherein like parts are designated by like numerals throughout. The present invention is related to a piezoelectric device for igniting, or otherwise initiating, components within an apparatus such as a flare or other projectile. More particularly, the present invention is related to a device for converting forces otherwise present in such an apparatus to electricity by means of a piezoelectric cell.

Figure 1:
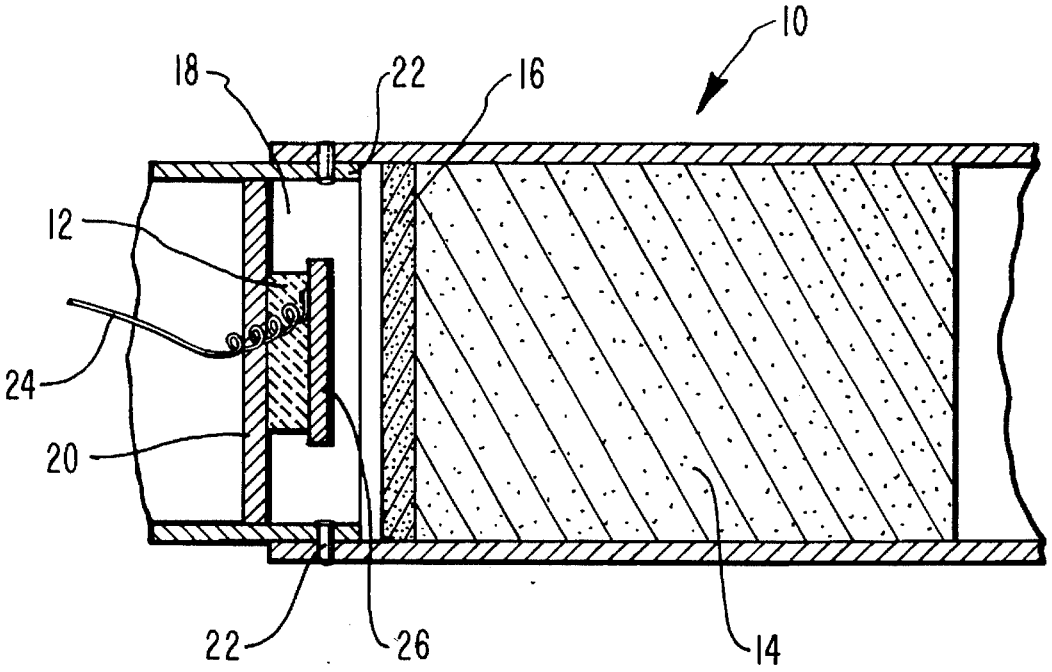
FIG. 1 is a cross sectional view of one embodiment of the piezoelectric cell of the present invention, and a portion of a surrounding apparatus.

One embodiment of the device of the present invention is illustrated in FIG. 1. FIG. 1 illustrates a piezoelectric cell 12 positioned within the body of an apparatus 10, such as a illumination flare, multi-stage rocket or other similar device. One acceptable piezoelectric material is a lead zirconate titanate ceramic such as that manufactured by EDO Corporation, Western Division, Salt Lake City, Utah. Positioned to the rear of the piezoelectric cell 12 is the separation fuze 14. In a typical rocket powered device, the rocket motor would be positioned to the rear of the separation fuze 14, with the separation fuze comprising means for disengaging the rocket motor from the remainder of the device.

In order to effect separation, a separation charge 16 is positioned toward the forward end of the separation fuze 14. The separation charge 16 comprises a conventional separation explosive which is initiated by conventional means. At the appropriate time in the operational sequence of the apparatus 10, the separation charge 16 explodes, causing a shock wave to propagate through the free volume separation charge chamber 18. Separation charge chamber 18 is disposed between the separation charge 14 and a rigid backing plate 20.

The explosion of separation charge 16 is specifically designed to shear shear pins 22, resulting in separation of the separation fuze 14 and attached rocket motor (not shown). It will be appreciated, however, that the shock wave of the explosion of separation charge 16 will also impact upon piezoelectric cell 12. This impact will result in corresponding electrical output through wire 24, which is attached to piezoelectric cell 12. Wire 24 places the piezoelectric cell 12 in communication with another electrically operated device within the apparatus 10. As a result, an electrical output from the piezoelectric cell 12 can be used to initiate the operation of such other device.

The device may also include a positive pressure plate 26 placed immediately on top of piezoelectric cell 12. Positive pressure plate 26 mediates and distributes the impact of the pressure wave from the separation charge 16 onto the piezoelectric cell 12 in order to achieve more even and efficient energy output from the piezoelectric cell 12.

In summary, the invention may operate under the following sequence of events. At a certain point in the operation of the apparatus, the rocket acceleration triggers the detonation of the separation charge by known techniques. Resulting pressure is built up in the separation charge chamber 18 and the gas or pressure wave strikes the piezoelectric cell 12. Impact of the pressure wave on the piezoelectric cell 12 results in sufficient deformation of the cell 12 (as well as shearing of shear pins 22) to cause the piezoelectric cell 12 to generate electrical energy.

As electrical energy is generated in the piezoelectric cell 12, it flows out of the cell through wire 24 and is transported to another device within the apparatus 10. For example, wire 24 may be placed in communication with an electrical squib, such as a semiconductor bridge. Such a device is known to operate at less than 0.25 mJ of energy, well within the capability of commercially available piezoelectric cells 12. In the case of a flare device, the squib may be positioned such that it ignites a quantity boron/KNO3 pellets, which in turn ignites the illuminant of the flare. This type of device will be discussed in additional detail with reference to FIG. 3.

It will be appreciated that any number of events may initiate operation of the piezoelectric cell 12. For example, such events may include combustion, ignition, hardware detachment, or similar events. Other similar non-aerospace events could also be used to operate the device in other settings. It is only necessary that a sufficient force be produced within the apparatus, a portion of said force being sufficient to cause operation of the piezoelectric cell.

Figure 2:
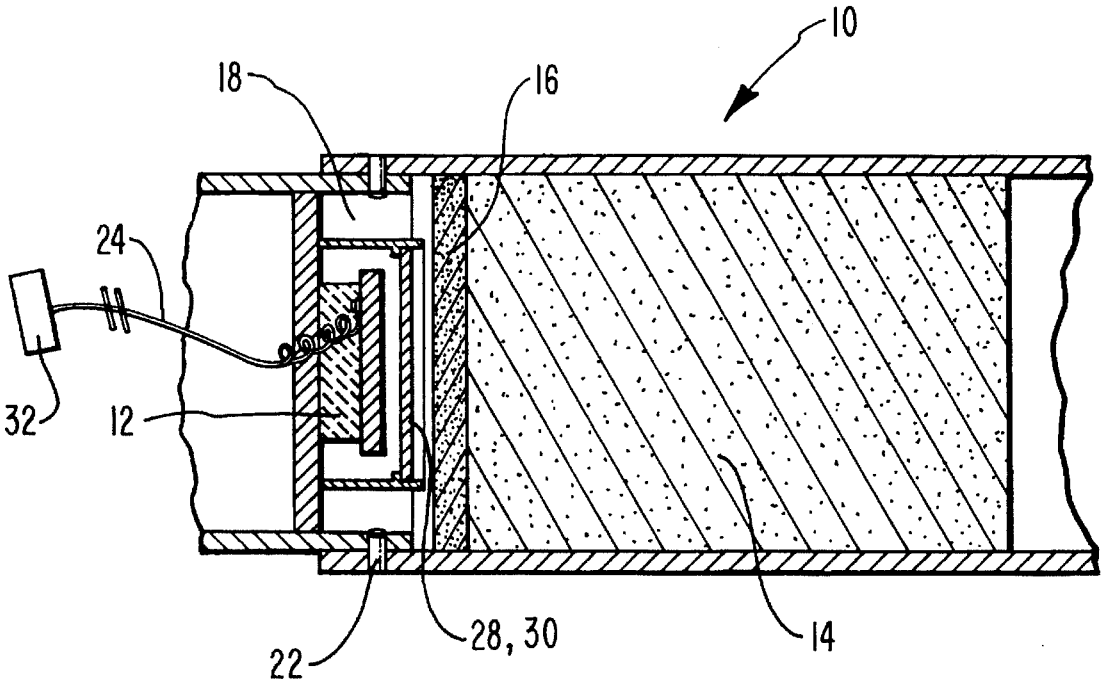
FIG. 2 is a cross sectional view of another embodiment of the piezoelectric cell of the present invention, and a portion of a surrounding apparatus.

FIG. 2 illustrates another embodiment of the present invention. As with the embodiment illustrated in FIG. 1, this embodiment is illustrated as being positioned within an apparatus 10. The apparatus includes a separation fuze 14 and a separation charge 16 for use in severing shear pins 22. As with the embodiment illustrated in FIG. 1, this embodiment utilizes a piezoelectric cell 12 mounted on a rigid backing plate 20 and positioned generally within a separation charge chamber 18.

The primary additional feature illustrated in FIG. 2 is the use of a burst diaphragm 28. Burst diaphragm 28 isolates piezoelectric cell 12 from the remainder of the separation charge chamber 18. A number of burst diaphragms are commercially available. Such burst diaphragms are generally rated by burst pressure. For example, burst diaphragms rated at 2,000 psi and 5,000 psi are commonly used.

In operation the separation charge 16 is initiated in the same manner as was described above. The pressure wave created thereby is prevented from impacting upon the piezoelectric cell 12 until it reaches sufficient strength to overcome the burst diaphragm 28. When this occurs, the burst diaphragm 28 releases flier plate 30 which is then forced by the pressure wave to impact piezoelectric cell 12. It is generally found that by using a burst diaphragm of this type, a more controlled and reproducible electrical output is achieved. Thus, there is an increase in reliability of the device.

Also illustrated in FIG. 2 is a squib 32. Squib 32 is placed in electrical communication with piezoelectric cell 12 by means of wire 24. It is, of course, necessary to select a squib, or other desired component which is capable of operation at the level of electrical output produced by the piezoelectric cell 12. As has been mentioned above, one such squib is a semiconductor bridge such as those manufactured by SCB Technologies, Albuquerque, N. Mex. Presently available semiconductor bridges are easily capable of operating with the electrical put out by commercially available piezoelectric ceramics.

In the operation of piezoelectric ceramics it is generally found that voltage output is directly proportional to the force of impact. Accordingly, it is necessary to place the piezoelectric cell at a location in the apparatus where it will encounter a sufficient force to produce the necessary voltage. One method for controlling, within necessary design parameters, the voltage output is to employ a burst diaphragm, or to employ a sufficiently large energy generation mechanism (such as an explosive).

Figure 3:
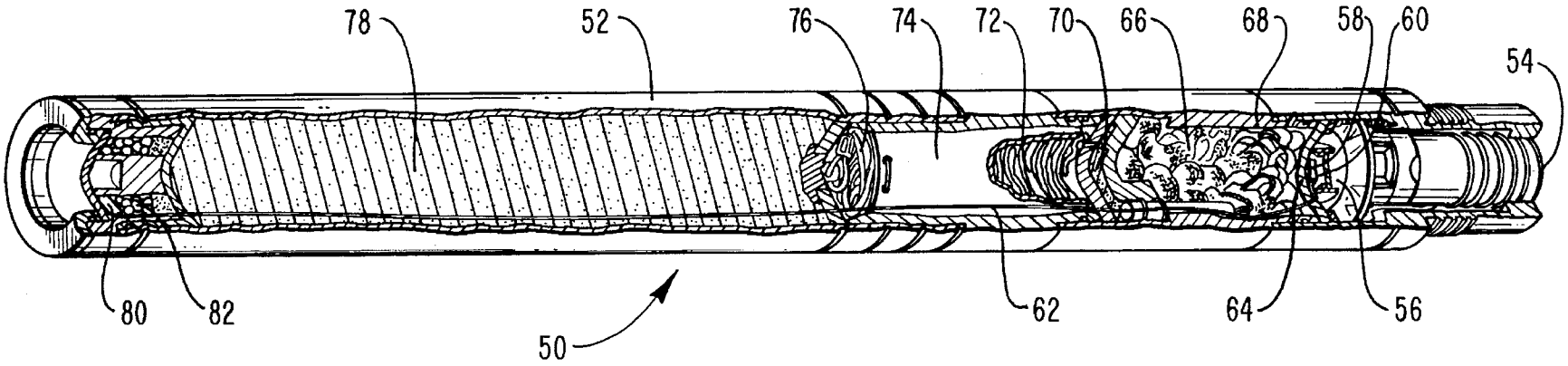
FIG. 3 is a partially cut away view of an illumination flare employing the present invention.

Reference is next made to FIG. 3. FIG. 3 illustrates a illuminating flare containing the present invention. This type of illuminating flare is rocket powered and is used to illuminate a relatively large area.

The flare 50 comprises a housing 52. At the rear of the housing 52 is the separation fuze 54. Separation fuze 54 is used in attaching a rocket motor (not shown) to the flare 50. Placed immediately forward of the separation fuze 54 is a separation charge 56. The general characteristics and function of typical separation charges has already been outlined above.

As was discussed with reference to FIGS. 1 and 2 above, a piezoelectric cell 58 is placed directly ahead of the separation charge 56 and within the separation charge chamber 60. Connected to the piezoelectric cell 58 and traveling forward through the housing 52 is a wire 62. As discussed above, the piezoelectric cell 58 rests on a rigid backing plate 64.

Immediately forward of the piezoelectric cell 58 and related components is a drogue parachute 66 stored within a drogue parachute compartment 68. An additional separation charge 70 is placed immediately forward of the drogue parachute compartment 68 and is used in the deployment of the flare's parachutes.

A main or pilot parachute 72 is placed ahead of the second separation charge 70. This parachute is located within a pilot parachute compartment 74. The pilot parachute is secured to the forward section of the flare by means of a cable 76.

Immediately forward of the pilot parachute compartment 74 is the illuminant 78, which constitutes the payload of the flare 50. It will be appreciated that it is very desirable to maximize the amount of illuminant within the flare 50 in order to maximize light output and length of operation. As will be discussed below, the present invention facilitate maximizing the illuminant load in the flare.

Placed immediately forward of the illuminant is the ignition system. Conventionally a bulky and complex mechanical igniter is located in this compartment, however, other types of conventional igniter may also have been used in similar devices. The contrast between conventional igniters and the present invention is obvious.

In FIG. 3 a squib 80 of the type described above is positioned in the igniter compartment. In particular, one presently preferred squib comprises a semiconductor bridge. Other squibs which are capable of operating on the output from the piezoelectric cell are also usable. Squib 80 is attached to the wire 62 which is in turn attached to the piezoelectric cell 58.

The squib 80 is placed in contact with conventional ignition materials in order to reliably ignite the illuminant 78. As shown in FIG. 3, such ignition materials may comprise Boron/KNO3 pellets 82. Thus, when the squib 80 is fired, it will in turn ignite the pellets 82. As can be seen from FIG. 3, the pellets are placed near the forward terminus of the illuminant 78. Accordingly, the burning of the pellets results in the ignition of the illuminant 78.

In operation, a rocket motor propels the flare to the desired location. At that point, the separation charge 56 is detonated, separating the rocket motor from the flare. Detonation of the separation charge 56 also impacts upon the piezoelectric cell 58 in the manner described above. This impact results in an electrical output from the cell 58 which is carried by wire 62 forward to the squib 80. In that the squib 80 has been chosen and designed to ignite with electrical outputs well within the range of the piezoelectric cell 58, the squib immediately ignites.

Ignition of the squib 80 then ignites the pellets 82. Once ignition of the pellets 82 is fully established, ignition of the illuminant 78 occurs. During this ignition sequence, the parachutes are deployed. Thus, the device is simultaneously lit and deployed over the desired area.

It will be appreciated that the same type of sequence involving the output of a piezoelectric cell could be employed in a number of similar contexts. It is only necessary that sufficient force be available to drive the piezoelectric cell. In summary, the present invention is able to use otherwise wasted energy produced within an apparatus to produce a triggering mechanism, through the piezoelectric cell, of additional required functions within the apparatus.

In the case of the flare 50, it is possible to eliminate several components which would otherwise be required. For example, it is conventional in this type of flare to attach a lanyard to a parachute at one end and to a mechanical striker mechanism at the opposite end. Therefore, when the parachute is deployed, the lanyard pulls on the striker, which in turn produces the necessary spark.

Using the present invention the lanyard can be eliminated. Since the lanyard typically travels through the illuminant compartment, it is possible to fill the space otherwise occupied by the lanyard with illuminant. Using the present invention only a small wire travels through the illuminant compartment. Thus, the quantity of illuminant carried by the device is significantly increased.

At the same time, the complex and expensive striker mechanism can be eliminated. One difficulty with such striker mechanisms is in providing adequate safety features. With the present invention, safety is improved because the piezoelectric cell only emits the necessary charge when impacted by a particular directed force, namely the force of detonation of the separation charge. Accidental operation is extremely unlikely.

In summary, the present invention provides a mechanism for initiating operational functions within devices such as military and aerospace devices. The device is capable of converting forces otherwise wasted in the device to usable electrical outputs. Using the present invention it is possible to generate a usable electrical output with energy otherwise produced during normal operation of the device. The device is extremely compact, reliable, and safe. Therefore, increased efficiency of the resulting apparatus is provided and increased loads are possible. Finally, the present invention is able to incorporate piezoelectric generating capability and is able to produce sufficient electrical output for the necessary purposes.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A mechanism for igniting a flare in midair, the flare attached to a rocket motor, said mechanism comprising:

a parachute disposed within the flare;

shearable connection means connecting the flare to the rocket motor;

a separation charge disposed and configured for producing an explosive shock wave for separating the flare from the rocket motor in mid-air by shearing said shearable connection means and for deploying said parachute;

a piezoelectric cell positioned within the flare to receive at least a portion of the force of said explosive shock wave, said piezoelectric cell capable of producing an electrical output in response to the impact of said explosive shock wave upon said piezoelectric cell;

a quantity of illuminate disposed within the flare;

an electrically actuated squib located adjacent said illuminate;

a wire placing said piezoelectric cell in electrical communication with said electrically actuated squib and means for insulating said piezoelectric cell from the force of detonation of said separation charge until such time as the force reaches a predetermined intensity said means comprising a burst diaphragm positioned between said piezoelectric cell and said separation charge wherein said burst diaphragm is constructed such that when a predetermined force is applied to said diaphragm at least a portion of said diaphragm disengages from the remainder of said diaphragm, thereby becoming a flyer plate.

* * * * *